United States Patent [19]

Williams

[11] Patent Number: 4,625,645

[45] Date of Patent: Dec. 2, 1986

[54] CORE GUN IGNITER

[76] Inventor: Robert A. Williams, 2721 White Settlement Rd., Fort Worth, Tex. 76107

[21] Appl. No.: 707,406

[22] Filed: Mar. 1, 1985

[51] Int. Cl.[4] ..... F42C 19/12

[52] U.S. Cl. ..... 102/202.14; 102/202.5

[58] Field of Search ..... 102/202.5, 202.14, 202, 102/322

[56] References Cited

U.S. PATENT DOCUMENTS

| | | | |
|---|---|---|---|
| 2,561,670 | 7/1951 | Miller et al. | 102/202 |
| 2,575,071 | 11/1951 | Rockwell | 102/202.5 |
| 2,681,701 | 6/1954 | Schlumberger | 102/202.14 |
| 4,557,197 | 12/1985 | Smith et al. | 102/202 |

FOREIGN PATENT DOCUMENTS

| | | | |
|---|---|---|---|
| 985092 | 7/1951 | France | 102/202.5 |

*Primary Examiner*—Charles T. Jordan

*Attorney, Agent, or Firm*—Arthur F. Zobal

[57] ABSTRACT

A housing forming a chamber has two openings extending to the chamber from opposite ends thereof. An electrical connector extends through one opening to the chamber and is sealed therein with a high temperature epoxy. A ring shaped sapphire jewel member surrounds the connector in its opening between the epoxy seal and the chamber. An explosive powder and an igniting element are located in the chamber. The igniting element is connected between the connector and the inside wall of the chamber. A tubular member has one end coupled to the other opening and an opposite end adapted to be located in an explosive charge. A silicone rubber plug is located under compression in the opposite end of the tubular member.

6 Claims, 4 Drawing Figures

CORE GUN IGNITER

BACKGROUND OF THE INVENTION

1. Field of the Invention

The invention relates to an igniter for an explosive charge.

2. Description of the Prior Art

In the oil industry, samples of the formations traversed by a bore hole are obtained for purposes of analysis. This is done by lowering a special tool into the bore hole to obtain core samples. In one embodiment, the tool comprises a plurality of core sampling members which are fired outward into the formations to obtain the core samples. Explosive charges set off by igniters are employed to fire the sampling members into the formation. Due to the structure of one type of tool, the igniters are exposed to the high pressure and temperature of the bore hole. In many cases, this high pressure and temperature destroys the igniters or prematurely sets them off resulting in unreliability.

SUMMARY OF THE INVENTION

It is an object of the invention to provide a reliable igniter for use in an environment of high pressure and high temperature for igniting an explosive charge.

The igniter comprises a metallic housing forming wall structure defining a chamber. First and second openings at opposite ends of said housing respectively extend through said wall structure to said chamber. An electrical connector extends through said first opening to said chamber. A sealing material surrounds said connector in said first opening and engages said connector and the wall of said first opening forming a seal between said connector and said wall of said first opening. Said sealing material is capable of withstanding high pressure and temperatures. A ring shaped sapphire member surrounds said connector in said first opening between said sealing material and said chamber. The ring shaped sapphire member engages said connector in said wall of said first opening forming a high temperature electrical insulating member capable of withstanding a high compressive load. Explosive powder is located in said chamber and a metallic igniting element in said chamber is electrically connected to said connector and to said wall of said housing. A tubular member has a first end coupled to said second opening and a second end adapted to be located next to an explosive charge. A plug of elastic material under compression is located in said second end of said tubular member. When electrical energy is applied to said electrical connector, said igniting element is heated causing said explosive powder in said chamber to explode and force said plug of elastic material out of said tubular member releasing the resulting heat and pressure from said chamber by way of said tubular member to said explosive charge for causing said explosive charge to explode.

In a further aspect, said sealing material comprises an epoxy and said elastic material comprises silicone rubber.

In another aspect, said first opening comprises a larger diameter portion next to the exterior of said housing and a smaller diameter portion next to said chamber with a shoulder formed therebetween. Said sapphire ring member has an opening formed therethrough with one side of said sapphire ring member located against said shoulder and with a portion of said connector extending through the opening of said sapphire ring shaped member. Said connector comprises an enlarged portion which engages the other side of said sapphire ring shaped member.

DESCRIPTION OF THE PREFERRED EMBODIMENTS

Figure 1:
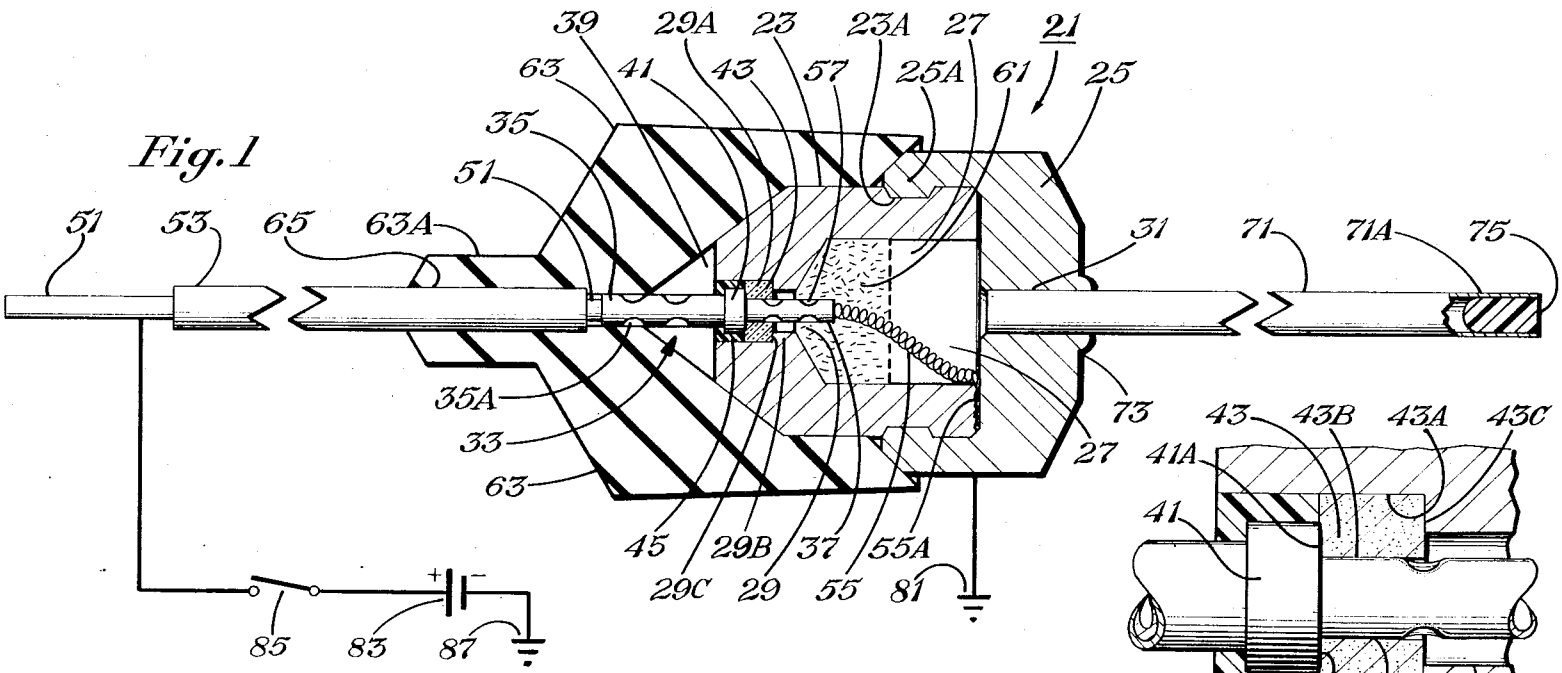
FIG. 1 is a partial cross-sectional view of the igniter of the invention.
Figure 3:
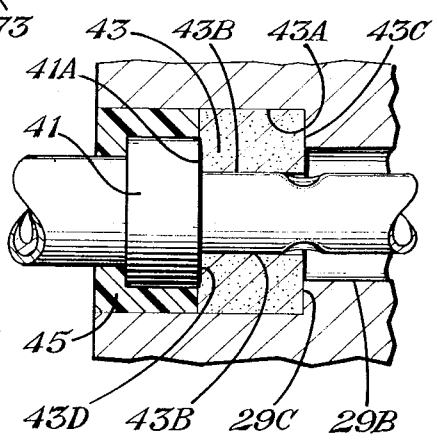
FIG. 3 is an enlarged portion of the igniter of FIG. 1.

Referring to the drawings, the igniter of the invention is identified at 21. It comprises a housing formed by a cup shaped aluminum plug 23 and a cup shaped aluminum cap 25 connected together to form a chamber 27. The plug 23 and cap 25 are connected together by locating the plug 23 in the interior of the cap 25 and deforming the end 25A of the cap 25 into the annular groove 23A formed in the outer side of the plug 23. An opening 29 extends through the plug 23 into the chamber 27 and a cylindrical opening 31 extends through the cap 25 to the chamber 27. The opening 29 comprises a larger diameter portion 29A and a smaller diameter portion 29B with an annular shoulder 29C formed therebetween. Extending through the opening 29 to the chamber 27 is an electrical connector 33 of brass. The connector 33 has opposite tubular ends 35 and 37 with an intermediate solid portion which comprises an enlarged diametered portion or shoulder 41 and the portions of the members 35 and 37 next to the enlarged portion 41. The connector 33 is supported in the opening 29 out of contact with the walls thereof by a sapphire ring jewel member 43 and a high temperature epoxy 45. The sapphire ring 43 has an outer cylindrical surface 43A and an inner cylindrical opening 43B. The tubular portion 37 of the connector 33 next to the enlarged portion 41 is located in the opening of the sapphire ring 43 with the outer radial portion of the side 43C of the ring 43 engaging the shoulder 29C and the side 41A of the enlarged portion 41 of the connector 33 engaging the inner radial portion of the side 43D of the ring 43. The outer surface 43A of the ring 43 engages the inside wall of the portion 29A of the opening 29. The epoxy material 45 surrounds and engages the enlarged portion 41 of the connector 33 and the portion of the tubular member 35 next to the member 41. The epoxy 45 also engages the inside wall of the portion 29A of the opening 29.

An electrical metallic wire 51 has its end located in the opening of the tubular portion 35 of the connector 33 and is crimped therein at 35A. Electrical insulation 53 surrounds the wire 51. A nickel-chronium coil spring 55 has one end located in the opening of the tubular portion 37 of the connector 33 and is crimped therein at 57. The other end of the spring 55 is crimped at 55A between the walls of the plug 23 and the cap 25. The spring 55 thus is electrically connected between the connector 33 and the plug 23 and cap 25 and acts as a heating element when an electrical current is completed through the element 55 to ignite explosive black gun powder 61 located in the chamber 27.

A cup shaped viton cover 63, formed of a fluorocarbon elastomer, tightly surrounds the outer portion of plug 23 extending from the cap 25 and encloses the portion of the connector 33 extending from the plug 23. The rear end 63A of the cover 63 has a small opening 65 formed therethrough for tightly receiving the insulated wire 51.

Figure 4:
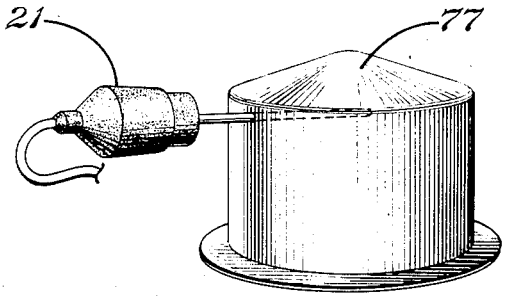
FIG. 4 illustrates the tubular end of the igniter extending into the shell of an explosive charge.

A metallic tubular member 71 has one end located in the opening 31 of the cap 35 and is crimped therein at 73. The outer end 71A of the tubular member 71 has a plug of silicone rubber 75 located therein under compression. The tubular member 71 has a very small diameter and its end 71A is adapted to be inserted within the shell 77 of an explosive charge as illustrated in FIG. 4.

In use in a bore hole tool for obtaining core samples, the housing comprising the plug 23 and the cap 25 will be grounded as illustrated at 81. The insulated wire 51 will extend to the surface where it will be connected to a source of electrical power 83 by way of a switch 85. The source 83 will be grounded as illustrated at 87. When the switch 85 is closed, an electrical circuit will be completed through the igniting element 55 causing it to be heated thereby causing the explosive powder 61 to explode. The force of the explosion will force the plug 75 from the tube 71 thereby allowing the pressure and heat in the chamber 27 to be blown out through the tube to the explosive charge 77 resulting in the charge 77 being exploded to perform its function.

Figure 2:
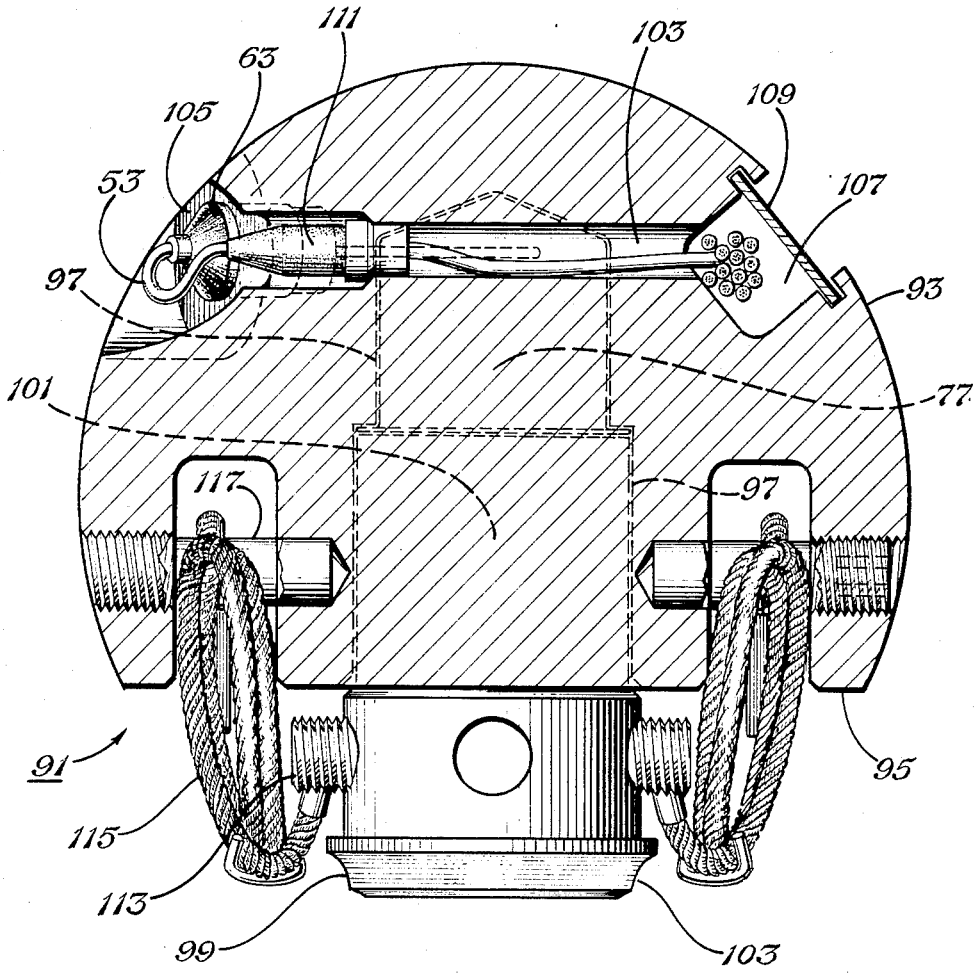
FIG. 2 is a cross-section of a bore hole tool illustrating the igniter of FIG. 1 as employed for igniting an explosive charge of a core sampling device.

Referring to FIG. 2, there is illustrated a cross-section of an elongated tool 91 adapted to be located within a bore hole traversing the earth formations. FIG. 2 is a cross-section taken through a plane transverse to the elongated axis of the tool 91. The tool 91 is formed of iron and at the cross-section as shown in FIG. 2, has a curved portion 93 which is greater than a half circle and a flat portion 95. The flat side 95 will face the bore hole wall when the tool is in the bore hole. A round aperture 97 extends from the flat side 95 toward and beyond the axis of the tool. A cup shaped core sampling member 99 has its rear end 101 located in the forward part of the aperture 97 and its forward open end 103 extending out of the aperture 97 beyond the flat side 95. The explosive charge 77 is located in the rear portion of the aperture 97. The sampling member 99 is held in the aperture 97 by shear pins (not shown). An aperture 103 extends through the tool 97 from a groove or indentation 105 to a slot 107 which extends along the length of the tool. The aperture 103 intersects the rear portion of the aperture 97. Aperture 103 is located on one side of aperture 97. Extending from the indentation 105 is a second aperture which forms an acute angle relative to aperture 103. The second aperture has a small portion which intersects aperture 97. The igniter 21 is located in the second aperture from the indentation 105 and is press fitted therein until the end 71A of its tubular member 71 punctures and is located within the shell of the explosive charge 77. Electrical lead 51, 53 of the igniter 21 extends through the aperture 103 to the slot 107 where it extends to the surface. A thin metal plate 109 covers the slot 107. An elastic plug 111 extends around the lead 51, 53 and is press fitted into the aperture 103. When the igniter 21 is actuated to explode the charge 77, the force of the explosion breaks the shear pins and fires the core sampling member 99 into the formations and the member 99 is embedded in the formation to obtain a core sample. The core sampling member 99 is secured to the tool 91 by way of posts 113 connected to the member 99, cables 115 connected to the posts 113 and to posts 117 which are connected to the tool 91. When the tool is removed from the bore hole, the core sampling device 99 with its formation core sample is pulled upward to the surface of the earth. The tool 91 will have a plurality of core sampling members 91 along its length each having its own charge 77 and igniter 21 for firing purposes.

The igniter 21 is exposed to the heat and pressure of the bore hole since its rear end covered by the cover 63 is exposed to the bore hole. The epoxy material 45 forms a seal between the connector 33 and the plug 23 capable of withstanding pressures up to 20,000 p.s.i. and temperatures up to 400° Fahrenheit. The sapphire ring 43 forms a high temperature electrical insulation member and is able to withstand very high compressive loads transmitted through the enlarged portion 41 of the connector 33. The silicone rubber seal 75 under compression forms a consistent seal. Black gun powder requires a consistent seal to deliver consistent firing. The only way to obtain consistent firing is to duplicate consistent confinement which is what the silicone rubber seal 75 under compression does. Thus, the igniter of the invention provides a very reliable igniter capable of being used in an environment under high pressure and high temperature.

In one embodiment, the ring shaped sapphire member 43 is a sapphire jewel bearing. The sapphire ring shaped member 43 is capable of withstanding a compressive load up to 90 m.o.h. scale. The epoxy 45 employed is identified as novimide 700 CM. The hardner employed is Pro 18 Spec. It is produced by Isochem Products. The silicone rubber 77 is commercially available. The tubular member 71 has an inside diameter of 0.040 of an inch. The silicone rubber seal 75 before insertion into the tubular member 71 has a diameter of 0.06 of an inch and is 0.035 an inch thick. It is extruded into the tubular member 71 to form a plug having a diameter of 0.040 of an inch with a length of 0.080 of an inch, thereby being under compression within the tubular member 71. The black gun powder 61 is identified as FFFFG Black Powder. The chamber 27 will be partially filled with the black gun powder 61.

Reference is made to Hackh's Chemical Dictionary, Fourth Edition, published in 1969 by McGraw-Hill, Inc., pages 244, 597, and 611, for definitions of epoxy, sapphire, and silicone rubber.

In assembling the igniter 21, the tubular end 37 of the electrical connector is inserted through the opening 43B of the sapphire member 43 and one end of the coil element 55 is inserted within the tubular member 37 and crimped therein. The electrical connector 33 with the sapphire ring 43 then is inserted into the opening 29 of the plug 23 and the cap 25 is connected to the plug 23 with the other end 55A of the coil 55 crimped between the plug 23 and the cap 25. The epoxy and the catalyst then are inserted into the enlarged portion 29A of the opening 29 around the shoulder 41 of the connector and around the tubular portion 35 next to the shoulder 41 as shown in FIG. 1, and the assembly then is baked to cure the epoxy. The tubular member 71 with the compression seal 75 then is inserted into the opening 31 and crimped therein at 73. The cover 63 is inserted around the insulated wire 51 and the end of the wire 51 is located within the tubular portion 35 of the electrical connector and crimped therein at 35A. The cover 63 then is fitted around the plug 23 as shown in FIG. 1.

I claim:

1. An igniter for use in a high pressure and high temperature environment for igniting an explosive charge, comprising:

a metallic housing having wall structure defining a chamber, first and second openings at opposite ends of said housing respectively extending through said wall structure to said chamber, an electrical connector extending through said first opening to said chamber, a sealing material surrounding said connector in said first opening and engaging said connector and the wall of said first opening forming a seal between said connector and said wall of said first opening, said sealing material being capable of withstanding high temperature and high pressure, a ring shaped sapphire member surrounding said connector in said first opening between said sealing material and said chamber, said ring shaped sapphire member engaging said connector and said wall of said first opening forming a high temperature electrical insulating member, explosive powder in said chamber, a metallic igniting element in said chamber electrically connected to said connector and to said wall of said housing, a tubular member having a first end coupled to said second opening and a second end adapted to be located next to an explosive charge, and a plug of elastic material under compressiòn located in said second end of said tubular member, when electrical energy is applied to said connector, said metallic igniting element is heated causing said explosive powder in said chamber to explode and force said plug of elastic material out of said tubular member releasing the resulting heat and force from said chamber by way of said tubular member to said explosive charge causing said explosive charge to explode.

2. The igniter of claim 1, wherein:

said sealing member comprises epoxy.

3. The igniter of claim 1, wherein:

said elastic material comprises silicone rubber.

4. The igniter of claim 1, wherein:

said sealing material comprises epoxy, and said elastic material comprises silicone rubber.

5. The igniter of claim 1, comprising:

means for completing an electrical circuit through said igniting element for heating said igniting element for causing said explosive powder in said chamber to explode.

6. The igniter of claim 1, wherein:

said first opening comprises an enlarged diameter portion next to the exterior of said housing and a smaller diameter portion next to said chamber with an annular shoulder formed therebetween, said ring shaped sapphire member having an opening formed therethrough with said electrical connector extending through said opening thereof, said ring shaped sapphire member having a first side engaging said shoulder formed between said enlarged diameter and smaller diameter portions of said first opening, said electrical connector comprising an enlarged portion engaging the other side of said ring shaped sapphire member.

* * * * *